United States Patent [19]

Longerich

[11] 4,231,311

[45] Nov. 4, 1980

[54] TOWABLE POD ASSEMBLY FOR PROTECTIVELY DISABLING INCOMING TORPEDOES

[75] Inventor: Ernest P. Longerich, Chatsworth, Calif.

[73] Assignee: The United States of America as represented by the Secretary of the Navy, Washington, D.C.

[21] Appl. No.: 939,012

[22] Filed: Sep. 1, 1978

[51] Int. Cl.[2] ..... B63G 8/24

[52] U.S. Cl. ..... 114/244; 89/36 N

[58] Field of Search ..... 114/240 R, 240 A, 240 C, 114/241, 242, 243, 244, 245, 246, 253, 311, 20 R, 20 B, 23, 24, 25, 14; 102/18 MS, 35, 35.6, 37.1, 37.6, 63, 89 R; 89/36 N

[56] References Cited

U.S. PATENT DOCUMENTS

| | | | |
|---|---|---|---|
| 1,759,912 | 5/1930 | Mount | 89/36 N |
| 3,005,973 | 10/1961 | Kietz | 114/244 X |
| 3,926,137 | 12/1975 | Johnson | 114/311 |

OTHER PUBLICATIONS

Popular Science, Jul. 1943, "Bomb Webs" p. 92.

*Primary Examiner*—Trygve M. Blix
*Assistant Examiner*—Jesús D. Sotelo
*Attorney, Agent, or Firm*—Richard S. Sciascia; Thomas M. Phillips

[57] ABSTRACT

A coaxial strain cable tows a tube-like net-containing pod behind a ship. Sensors on the pod carried beneath the ships wake detect incoming torpedoes and supply detection data via the coaxial cable to a shipboard processor. Processor commands return via the cable to a pod motor to drive rudders and maneuver the pod into the torpedo path. Drogue and main parachutes packed in the pod are released into the path by other cable-carried commands. Power for the motors and a 'chute release mechanism also is supplied through the cable. The main 'chute is formed of a low drag aramid fiber mesh strong enough to arrest the torpedo. Preferably, explosives carried by the 'chute destroy it.

20 Claims, 6 Drawing Figures

TOWABLE POD ASSEMBLY FOR PROTECTIVELY DISABLING INCOMING TORPEDOES

BACKGROUND OF THE INVENTION

The invention relates to means for disabling incoming torpedoes and, in particular, to net-like barriers for intercepting and destroying the torpedoes.

There have been numerous proposals suggesting the use of net-like structures to form barriers for intercepting, capturing and, in some instances, destroying incoming torpedoes. These proposals, however do not seem to have met with any particular success. At least, net-like barriers have not been used to any appreciable extent to protect under way ships traveling in the open sea. Other applications, such as moored or buoyed nets used in fixed positions to protect harbor entrances or the like, are not of present concern. Instead, as indicated, the present concern primarily involves under way ships. More specifically, the present invention is concerned with protecting under way ships against so-called 'wake-following' torpedoes. Such wake-following torpedoes present special problems one of which is the ability to acoustically detect the incoming torpedo in or through the heavily disturbed wake.

In a broader sense, the known prior art has not been concerned with torpedo attacks directed along a ship's wake or with the possibility of towing an intercept barrier behind the ship for torpedo-capturing purposes. Several factors tend to discourage the use of any such towed arrangement. First, any such net obviously must have sufficient strength to stop the heavy, high-speed torpedoes. To achieve the necessary strength, the nets must be quite heavy and, the weight, in turn, imposes extreme drag force on the tow. Another factor is that, to assure an actual intercept, a towed net should have a capability of being maneuvered into an intercept position once the torpedo path is detected. In practice, due to the requisite size and weight, it is just about impossible to achieve the maneuverability within the limited time frame between detection and intercept.

An object of the invention is to provide a ship with the capability of towing a net beneath the ship's wake without imposing unacceptable drag forces on the tow. A further object is to provide a maneuverability that permits the tow to be moved quickly into the torpedo path. Other objects are to improve the ability to detect torpedoes and to provide an efficient and reliable system for processing sensor data and deriving command signals for the manuevering and for net-release purposes. Other objects will become apparent in the ensuing description.

Generally, the objects are achieved by providing a maneuverable towed pod assembly in which the net is packed for towing purposes. In the preferred form, the sensors for detecting the torpedo are carried by the pod beneath the wake and their information, along with other pod-position data, is processed on the ship for relay back to the pod along with the power for maneuvering and also for achieving a timed release or deployment of the net.

BRIEF DESCRIPTION OF THE DRAWINGS

The present invention is illustrated in the accompanying drawings of which.

DETAILED DESCRIPTION OF THE INVENTION

Figure 1:
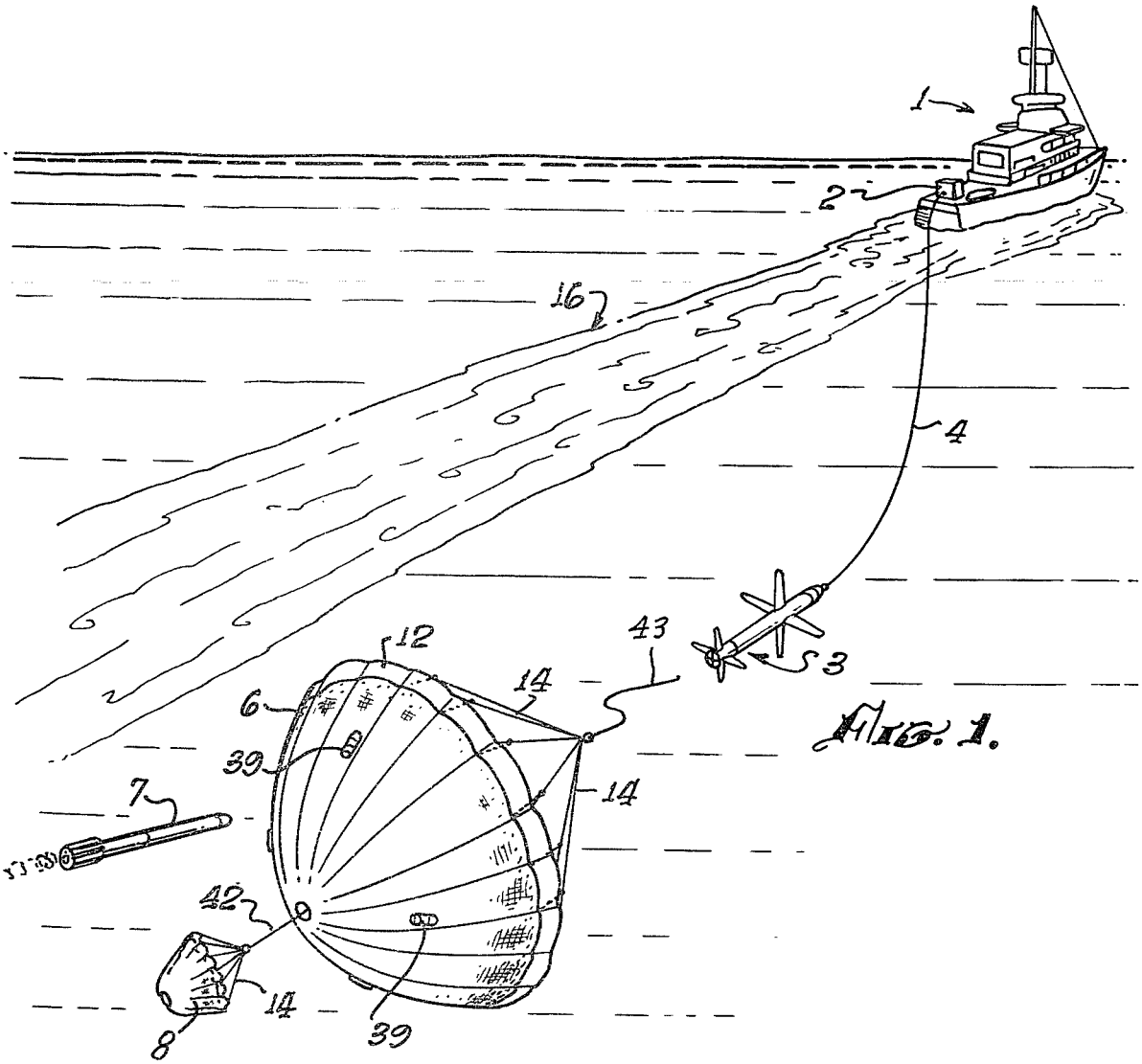
FIG. 1 illustrates the operation of the present towed pod assembly.

A surface ship 1 having a winch 2 tows a pod assembly 3 by means of a coaxial strain cable tow line. In FIG. 1, a main parachute 6 has been released from its normally packed containment within the pod and, in its fully opened disposition, lies directly in the path of an incoming torpedo 7. A drogue parachute 8 is used to assist in the opening of the main parachute.

Operationally considered, 'chute 6 is a net-like structure formed of light-weight, high-strength aramid fibers. In one form of the invention, the net is of sufficient strength to actually capture the incoming torpedo and, of course its continued travel to ship 1. In another form, the parachute is provided with explosives which are detonated by the impact of the torpedo to destroy it. In either case the torpedo is disabled and prevented from inflicting damage on ship 1. The use of explosives permits the 'chute to be formed of a lighter construction since the objective primarily is to arrest the torpedo, produce the impact and achieve the disabling through the explosives. In a particular application, a three inch web might be used for the non-explosive type. When explosives are used, a six inch web can be used. In either case, a prime consideration is to materially reduce the size and weight to an acceptable limit since, as can be appreciated, any large net-like structure imposes substantial drag on tow line 4. The total drag force should be limited to that permitted by conventional strain cables. It might be noted that there have been several publications describing the opening of the towed cables in water and the drag forces produced both by the opening and the steady tow. One such is that of M. H. L. Waters and B. G. Gayle "A Comparison of the Performance of Small Parachutes in Air and Water"; Technical Not. No. NE319, Royal Aircraft Establishment, Farnborough, England, August 1960. This paper discusses not only the steady drag force produced by the 'chute but also the shock loading produced during the opening of the 'chute. Its conclusion is that the shock loading is approximately 1.05 times the steady drag force. In any present design considerations both shock loading and steady drag should be considered.

Figure 2:
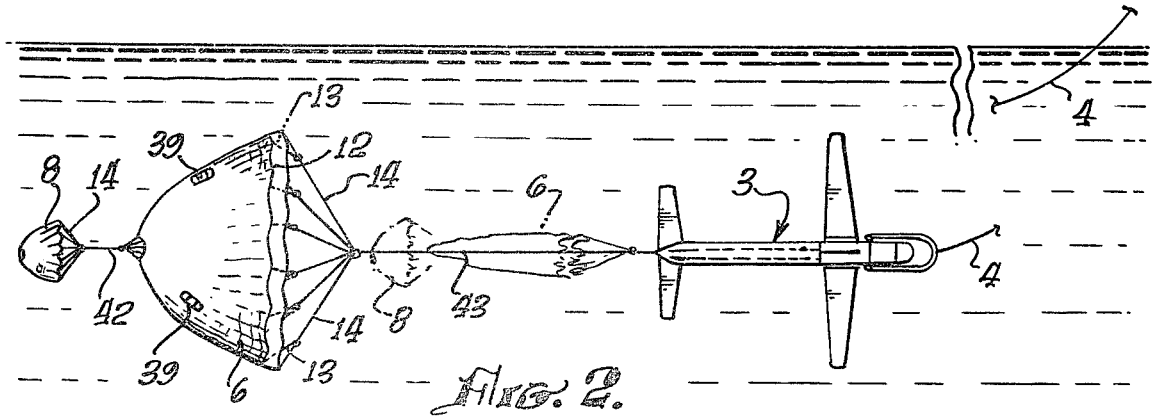
FIG. 2 is a illustration similar to FIG. 1 but showing the operation of a drogue-assisted main intercept parachute.

It also is most desirable to assure that parachute 6 opens rapidly. For this purpose, 'chute 6 preferably is formed with an open mesh central portion rimmed by a low porosity skirt portion 12. Skirt 12 generates a force vector to expand the mouth of the parachute rapidly and yet reduce the overall drag compared to a completely low porosity 'chute. Further advantage can be obtained by fixing the angle of attack of the skirt by using a dual set of 'chute lines 13 and 14 as shown in FIG. 2.

It also will be noted that, as shown in FIG. 1, pod assembly 3 is towed beneath wake 16 of the traveling vessel. A significant advantage achieved by such a tow is a marked improvement in the ability to detect incoming torpedo 7. In this regard, it is a known fact that detection through a heavily disturbed wake medium presents serious difficulties. In a manner to be described, detection presently is achieved by mounting appropriate sensors on the pod assembly so that the sonar, in effect, does not have to look through the wake. Torpedo 7 is intended to illustrate what is known as a wake-following torpedo. As the name implies, such torpedoes have a tracking capability relying somewhat upon the disturbance in wake 16. However, although the present invention primarily is concerned with wake-following torpedoes, protection against any attack directed aft of the vessel is contemplated. As will be described, pod assembly 3 is maneuverable and can be moved in any direction to position it in the sensed path of the incoming torpedo.

Figure 3:
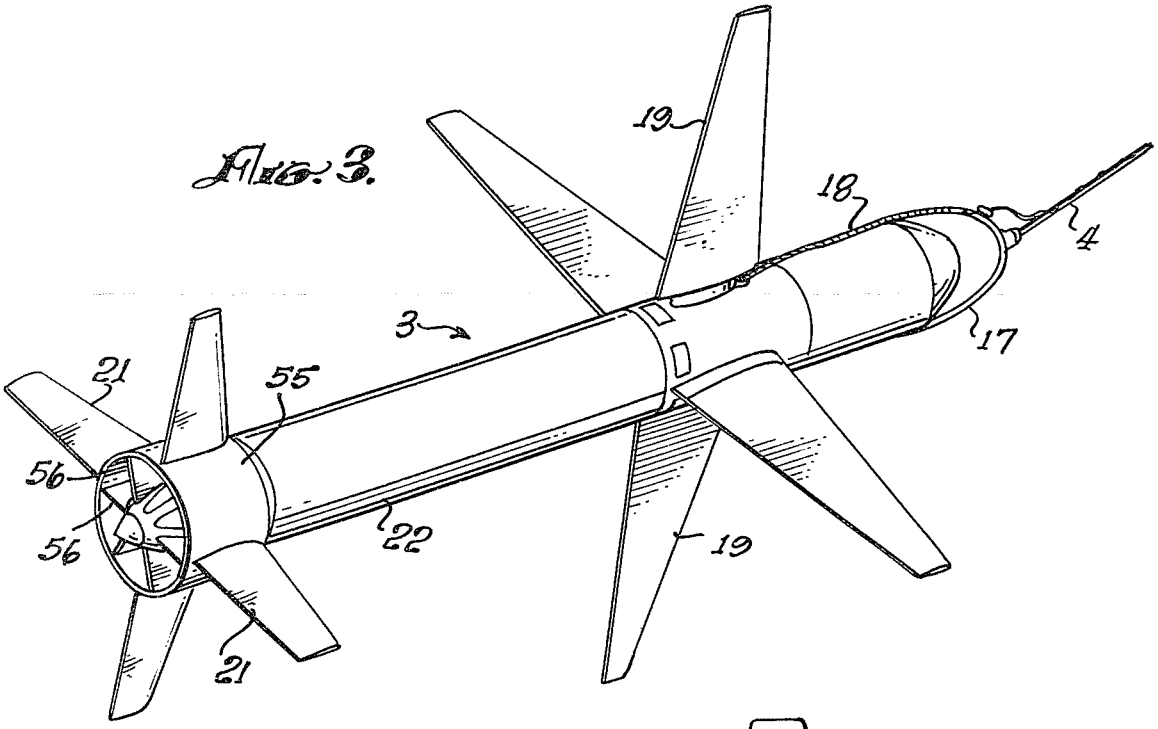
FIG. 3 is a side elevation of the net-containing pod assembly.

The perspective view of FIG. 3 shows the exterior configuration of pod assembly 3. In particular, the pod is an elongate, tube-like structure having a towing yoke 17 coupled to tow line 4 which, of course, is wound on and deployed from winch 2 of the ship. Towing cable 4 is a coaxial strain cable having a steel wire exterior providing the requisite strength and interior coaxial copper conductors carrying power and command signals to various pod components. As will be described, it also is used to transmit sensor signals from the pod to the ship. Commercial cables can be used for these purposes. For example, an electromechanical cable marketed by Amergraph has been used. This cable is a special multi-conductor having a breaking strength of about 33,000 lbs. provided by outer and inner layers of high strength, preformed and prestressed steel wire. Cable 4 is connected into the pod by being plugged into an input cable connector 18. The pod itself is a streamlined structure provided on its forward portion with large rudders 19 and on its aft end with four radially-extending stabilizers 21.

Figure 4:
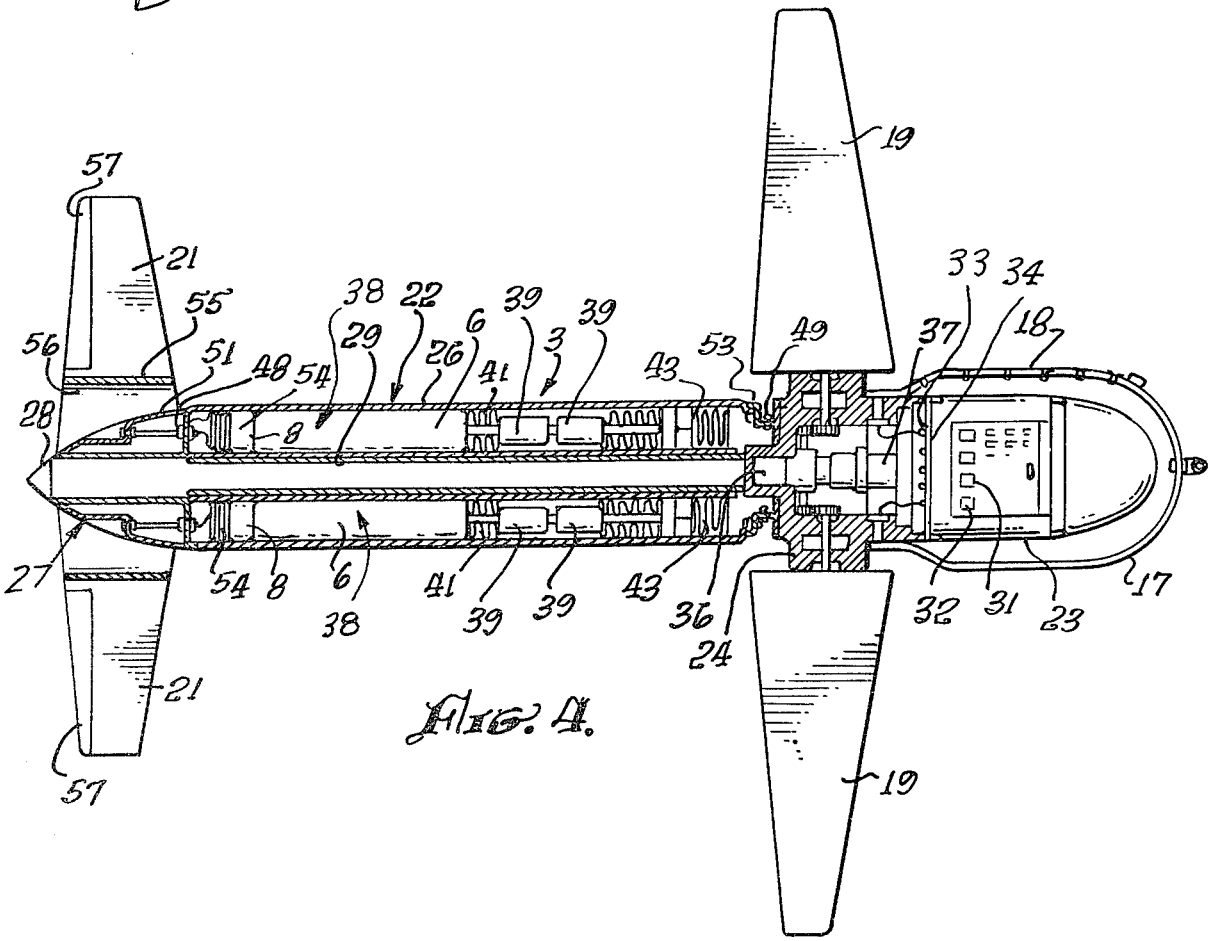
FIG. 4 is a central longitudinal section taken on FIG. 3.

Generally considered, pod assembly 3 is an elongate tubular casing 22 formed with a nose cone 23 (FIG. 4), a central casting 24, a tubular section 26, a tail housing 27 and a spun tailcone 28. A support tube 29 extends axially of the casing from central casting 24 to tail cone 28. Nose cone portion 23 is an electronics and electrical section containing circuit cards 31 and pod-position and attitude sensors 32 which will be further described. As shown in FIG. 4, power and command signals are coupled into this section through cable connector 18 which is coupled through casting 24 to bulkhead connectors 33. Bulkhead 34 also partitions the electronics section from the central casting section. Steerable rudders 29 are carried by the central casting and driven by control motors 36 and 37 which derive their power through leads coupled to the bulkhead connectors. As will be appreciated, the rudders are rotatably driven through appropriate gear mechanisms about their longitudinal axes to move pod assembly 3 in any desired direction. Motor control commands also are supplied through the electrical connections.

Main and drogue parachutes 6 and 8 along with various 'chute-deploying mechanisms are stored or packed in tubular section 26 for release and deployment once the pod has been maneuvered into a torpedo-intercept position. However, in the preferred arrangement shown in the drawings, the present pod is provided with a plurality of parachute units or barrier assemblies which can be deployed singly or in a successive manner to provide greater versatility and an increased effectiveness for the intercepts. Specifically, the present pod assembly provides for the storage of six independently controllable barrier assemblies 38 each of which has its own main 'chute 6, drogue 'chute 8, explosives 39 and an explosive support and detonation line arrangement 41. Also included in each assembly 38 are the essential 'chute lines 14 (FIG. 2) and tether lines 42 and 43 respectively coupling the drogue to the main 'chute and the main 'chute to pod 3.

Figure 5:
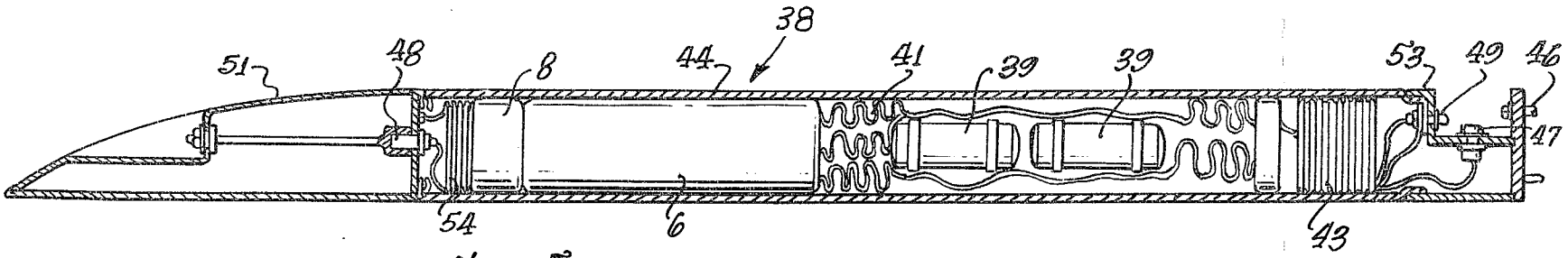
FIG. 5 is a longitudinal sectional view of one of a number of barrier assembly units used in the pod assembly.

One of the barrier assemblies 38 is shown in FIG. 5. As there seen, the assembly is contained within its own cylindrical tube 44. To initially load the pod, the packed assembly tubes are slid into the aft end of casing 22 (FIG. 4) and electrically connected by a securing bolt 46 and an input connector 47. Each end of each tube is closed to provide water-tight integrity and the closures are secured by signal-responsive explosive bolts 48 and 49. Bolt 48 secures a separable aft cover panel 51 which covers the aft end of the tube 44 and bolt 49 secures a forward panel 53 covering the forward end of the tube.

To deploy the 'chutes for intercept purposes, explosive bolt 48 is electrically activated to release cover 51 which enters the water stream pulling the drogue 'chute into the water. The pulling force is applied through a drogue release line 54 securing the drogue to the separable cover. As shown in FIG. 2, drogue 8 opens and pulls main 'chute into the water through tether line 42. The tether lines remain connected to the barrier assembly during erection of the 'chutes. Once the main 'chute barrier has been erected, explosive bolt 49 is activated for the double purpose of releasing tether line 43 and for flooding the forward portion of barrier assembly tube 44. Flooding is achieved by opening cover 53. Admitting water into the forward portion reduces the change of air entrapment which would adversely affect the pod buoyancy. The aft portion is flooded when the main 'chute is dispensed. As will be appreciated, the barrier assembly is configured to be neutrally buoyant. All release explosive bolts are selected and operated from shipboard via the two cable electrical conductors. A sequence of six 'chute assemblies thus can be dispensed by a series of commands sent via the pod electronic section. Hard wire connections of telemetry can be used for bolt activation.

Four stabilizers 21 are carried by the aft section of the pod. More specifically, as shown in FIG. 3, the stabilizers are carried by a cylindrical sleeve 55 supported by spoke-like arms 56 extending radially from the aft end portion of tube 29. The sleeve support for the stabilizers is needed because of the use of the six barrier assembly units. Thus, as already stated, each of these units is slid into the aft end, and obviously, there must be entry space available for the loading as well as exit space for the release. If the four stabilizers extended directly outwardly from the central tube itself, they would interfere with this entry space. As will be appreciated, aft cover panels 51 of barrier assemblies 38 lie between radial arms 56. Such an arrangement permits water to enter into the spaces between the barrier assemblies although, of course, the assemblies themselves are water-tight until blown by the explosive bolts. The entry of the water into the pod externally of the barrier assemblies assists in achieving the desired neutral buoyancy of the entire tow pod structure.

Another significant feature of the present arrangement is the fact that detection of the incoming torpedo is achieved by mounting sensors, such as sonar transducers 57, on the four stabilizers of the pod. These transducers detect the incoming torpedo and provide the data needed by a signal processor to determine its path. Once the path is determined, commands can be given to motors 36 to drive rudders 19 and maneuver the pod into an intercept position for release of the 'chutes.

One of the prime requirements for this type of operation is to provide a capability for detecting and accurately determining the torpedo path. Shipboard sensors, of course, can be used, but these sensors do not provide the requisite reliability since they are required to 'look' through the wake for their information. As is known, the poor acoustic environment of the wake tends to produce unreliable sonar date. Also, reliability is reduced due to the proximity of any hull-mounted transducer to the ships propellers. In the present arrangement, these difficulties are avoided by mounting the transducers on the stabilizers. The pod, as shown, is towed beneath the ships' wake. Consequently, the raw sonar data obtained by the transducers has significantly improved accuracy and reliability.

Figure 6:
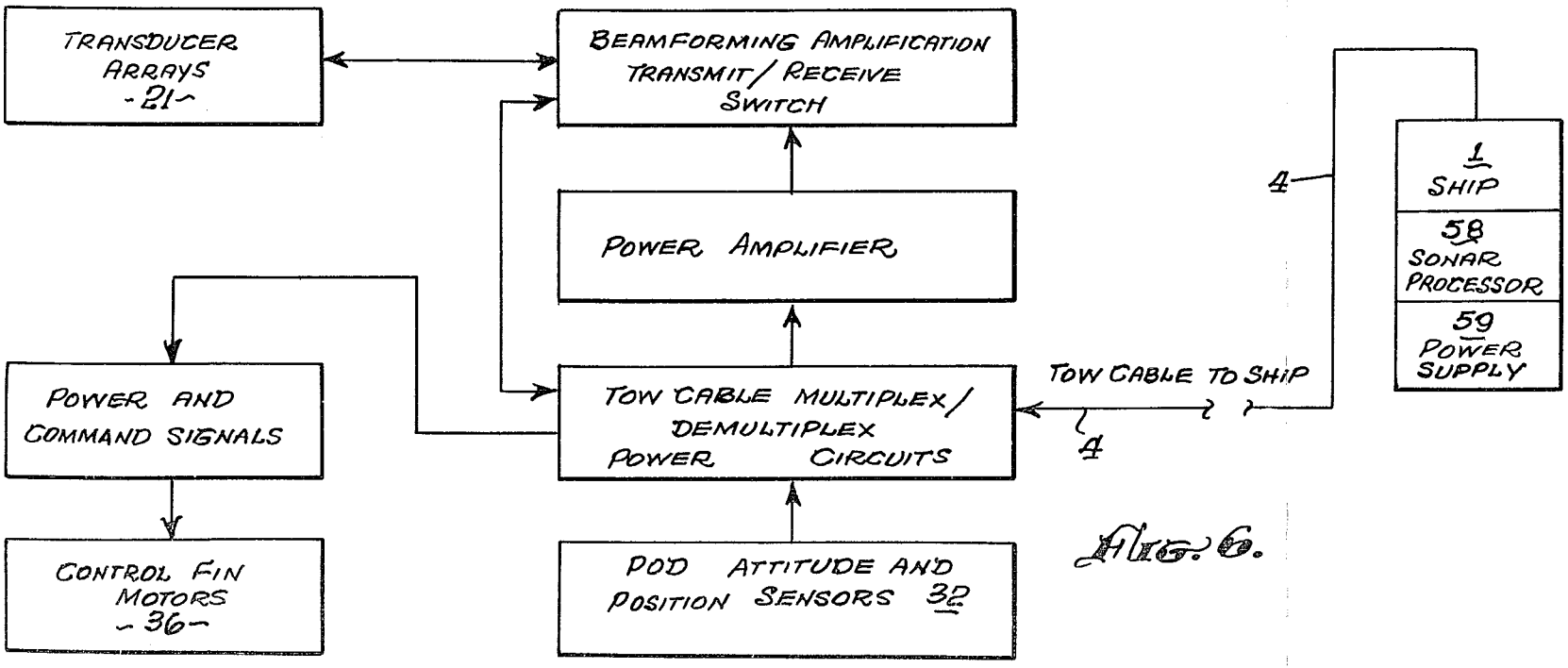
FIG. 6 is a block diagram showing a sensor system for the towed pod.

FIG. 6 is a block diagram of the pod sensor system. In this system data sensed by the pod is carried by coaxial tow line 4 to the ship where it is applied to a processor 58 to derive the required information. Command signals then are relayed back to the pod for controlling the maneuvering and for 'chute-deploying purposes. A power supply 59 of the ship also is transmitted to the pod via coaxial cable 4 for the motor drive and explosive bolt activation.

More specifically, as shown in FIG. 6, signals from transducer sensors 57 and pod attitude and position sensors 32 both are multiplexed up the tow cable to the ship and power and command signals then returned to the pod. Pod attitude and position sensors 32 may include pod heading, pitch, roll, accelerometers and depth sensors. Based upon their data as well as the ship's speed and, possibly, tow line tensions, pod position is estimated either by the use of standard algorithms for standard maneuvers or by a general computer for any arbitrary maneuver. Acoustic tracking of the pod itself by hull-mounted transducers looking dead aft is not considered feasible because of the previously-mentioned poor acoustic environment. Transducers 57 provide raw sonar data modulated into a broad-band data channel on the coaxial cable for use by the ship's processors. Also, if desired, mode selection, either active or passive, is shipboard selectable providing, of course, the sonar systems are so adapted.

Obviously, other specific implementations of the pod sensor system are contemplated. However, there is substantial advantage gained by incorporating all the sensors in the pod and in using shipboard processors and power to accurately estimate the relative positions of the pod and the torpedo. In this manner, effective maneuvers can be achieved with a high intercept probability upon the deployment of the 'chutes. Another advantageous feature of the present towed pod arrangement is that it includes the described plurality of 'chute assemblies. Consequently, if desired, a pair or more of 'chutes can be deployed for one intercept operation to greatly increase the intercept probability.

In general, the arrangement which has been described provides a highly effective manner of protecting under way ships against wake-following torpedoes. Various tests which have been conducted establish the ability of the tow to maneuver into position and to release and erect its protective barrier in a short enough time frame to achieve an intercept of the sensed torpedo. As will be appreciated, there is an absolute need not only for rapid responses to the sensed data but also for the rapid deployment and erection of the main 'chute. In the present arrangement a number of factors contribute to the reduction of this time frame. Some of these factors include the rapid generation of the command signals, the use of explosive bolts or the like for release and the use of the skirted net-like barrier which is designed for quick opening. Additionally, the use of high-strength aramid fibers for the net not only assures capture of the torpedo but also significantly lightens the drag forces and thus enables the use of conventional coaxial strain cables for towing.

Obviously many modifications and variations of the present invention are possible in the light of the above teachings. It is therefore to be understood that within the scope of the appended claims the invention may be practiced otherwise than as specifically described.

I claim:

1. Apparatus for intercepting and disabling underwater torpedo-like missiles directed toward a ship comprising:

a towable pod in the form of an elongate tube-like casing, tow cable means for towing the pod aft of the ship, means for detecting the incoming path of said missiles, a missile-disabling main parachute stored in said tube-like pod casing, and means for releasably deploying the main parachute into said incoming path for providing an intercept barrier for engaging and disabling the missiles.

2. The apparatus of claim 1 further including:

means for movably positioning said pod in said incoming path.

3. The apparatus of claim 2 wherein said means for positioning said pod includes:

rudder means movably carried by said pod casing, motor means mounted in said casing for driving the rudder means, power supply means for driving said motor means, and drive control means responsive to said detecting means for controlling said motor means and positioning said pod in said missile path.

4. the apparatus of claim 3 wherein said power supply means includes said tow cable means.

5. The apparatus of claim 4 wherein said drive control means includes said tow cable means.

6. The apparatus of claim 3 wherein said missile path detecting means includes:

sensor means carried by said pod casing for detecting an incoming missile, and power supply means for said sensor means.

7. The apparatus of claim 6 wherein said sensor power supply means includes said tow cable means.

8. The apparatus of claim 7 further including:

means for processing information derived from said sensor means for determining said incoming missile path, and means for supplying said processed information to said drive control means whereby said pod is moved into said incoming path.

9. The apparatus of claim 8 wherein said tow cable means is a coaxial strain cable, said apparatus further including:

electric circuit means for supplying said sensor information to said processing means and said means for supplying said processed information to said drive control means also including electric circuit means, said circuit means including said coaxial tow cable and, said processing means being carried on said ship.

10. The apparatus of claim 9 further including:

stabilizing fins carried by said pod casing, said sensor means being mounted on said stabilizing fins.

11. The apparatus of claim 1 wherein said means for releasably deploying the main parachute includes:

a drogue parachute packed in said pod casing, a tether line coupling said drogue to said main parachute, and means for releasably deploying said drogue parachute whereupon it pulls said main parachute from said casing.

12. The apparatus of claim 11 wherein said means for releasably deploying the drogue parachute includes:

an explosive bolt means, and command signal means for activating said bolt means.

13. The apparatus of claim 12 wherein said command signal means includes said tow cable means.

14. The apparatus of claim 12 further including:

a second tether line coupled at one end to said main parachute, another explosive bolt means securing the other end of said second line to said pod casing, and command signal means for activating said other explosive bolt means.

15. The apparatus of claim 14 wherein said tube-like pod casing includes:

a plurality of main parachutes each having its own drogue parachute and each being independently secured to said casing by a tether line and being independently released responsively to a command signal means.

16. The apparatus of claim 14 further including:

means for flooding said casing interior responsively to the release of said main parachute tether line.

17. The apparatus of claim 14 wherein both drogue and main parachute command signal means include said tow cable means.

18. The apparatus of claim 1 wherein said main parachute has a control portion formed of a high porosity mesh and a skirt portion formed of a low porosity material.

19. The apparatus of claim 18 further including:

means coupling said skirt portion to the main parachute tether line, said means expediting the opening of said parachute by fixing the angle of attach of said skirt when said parachute is deployed.

20. The apparatus of claim 18 wherein the mesh of said central portion is formed of high strength aramid fibers.

* * * * *